US005553682A

United States Patent [19]

Batliner et al.

[11] Patent Number: 5,553,682

[45] Date of Patent: Sep. 10, 1996

[54] ROCK DRILL

[75] Inventors: Rainer Batliner, Schaanwald, Liechtenstein; Anton Knoller, Landsberg; Axel Neukirchen, München, both of Germany

[73] Assignee: Hilti Aktiengesellschaft, Fürstentum, Liechtenstein

[21] Appl. No.: 474,846

[22] Filed: Jun. 7, 1995

[30] Foreign Application Priority Data

Jun. 4, 1994 [DE] Germany ..... 44 19 641.5

[51] Int. Cl.[6] ..... E21B 10/40

[52] U.S. Cl. ..... 175/395; 175/400; 76/108.6

[58] Field of Search ..... 175/383, 385, 175/395, 415, 320, 388, 400, 398; 76/108.2, 108.6; 408/59, 227, 230

[56] References Cited

U.S. PATENT DOCUMENTS

| | | | |
|---|---|---|---|
| 580,398 | 4/1897 | Hoenscheid | 76/108.2 X |
| 599,537 | 2/1898 | Steudner | 76/108.6 X |
| 750,537 | 1/1904 | Hanson | 76/108.6 X |
| 2,217,202 | 10/1940 | Gelpcke | 175/395 |
| 3,089,354 | 5/1963 | Claas et al. | 76/108.6 |
| 4,286,677 | 9/1981 | Guex | 175/395 |
| 4,898,503 | 2/1990 | Barisk | 76/108.6 X |
| 5,297,456 | 3/1994 | Nishimura | 76/108.6 |
| 5,423,640 | 6/1995 | Lindblom et al. | 408/230 |

*Primary Examiner*—Frank Tsay

*Attorney, Agent, or Firm*—Anderson Kill Olick & Oshinsky, P.C.

[57] ABSTRACT

A rock drill includes an axially elongated shank with a chucking shank part (1) at one end, a drilling shank part (2) extending from the chucking shank part and having at least four drilled material conveying flutes (4, 5, 6, 7) disposed next to one another in a parallel manner, and a drilling head at the opposite end of the shank and formed of hard metal and having four removal flutes (8, 9, 10, 11) spaced apart about its outer circumferential surface. The removal flutes have transverse cross-section of different size and each of the transverse cross-sections of the removal flutes (8, 9, 10, 11) open into one of the conveying flutes (4, 5, 6, 7) of the drilling shank part.

9 Claims, 1 Drawing Sheet

ROCK DRILL

BACKGROUND OF THE INVENTION

The present invention is directed to a rock drill with an axially elongated shank with a chucking shank part at one end, a drilling shank part extending from the chucking shank part with at least four conveying flutes in the drilling shank arranged in parallel relation and a drilling head formed of hard metal secured to the other end of the shank with four removal flutes spaced around the circumference of the drilling head. The transverse cross-sections of the conveying flutes and the removal flutes are in register.

Rock drills of the above type are used to cut bore holes in rock, concrete, masonry and the like. It is known that such rock drills wear out very rapidly in the region of the drilling head when drilling in a hard strata. Therefore, rock drills are formed of a hard metal and the term "hard metal" is meant to describe sintered or fused carbide, silicate, boride or their alloys.

Such a rock drill is disclosed in U.S. Pat. No. 2,673,716. This rock drill has a drilling head formed entirely of hard metal connected to a drilling shank with the drilling head having four drilled material removal flutes extending in the axial direction of the drilling head with the flutes uniformly spaced around the circumference of the head. The drilling head has a centrally disposed projection for connecting the head to the drilling shank, whereby the projection extends into a corresponding recess in the drilling shank.

The continuous removal of the drillings or drilled material by this known rock drill during operation occurs through the removal flutes running in the axial direction of the drilling head to drillings conveying flutes in the drilling shank. The flutes in the drilling shank extend in a helical manner and register with the removal flutes on the drilling head. Since the transverse cross-section of the removal flutes in the drilling head are of equal size, the same amount of drillings is carried away through each removal flute during the drilling operation. When removing very soft or brittle material, jamming of large grain drillings in the removal flutes can occur. Additional drillings collecting in the removal flutes press radially outwardly against the borehole wall so that on one hand an increased torque must be applied to drive the rock drill while on the other hand damage to the borehole wall takes place, particularly due to off-center running of the rock drill.

SUMMARY OF THE INVENTION

Therefore, the primary object of the present invention is to provide a rock drill with a drilling head formed of a hard metal characterized by a high drilling output, a long useful life, smooth operation and an effective removal of the drillings or drilled material.

In accordance with the present invention, the transverse cross-sections of the removal flutes in the drilling head have different sizes.

Since the removal flutes have different sized transverse cross-sections, different sized drillings can be effectively removed. The larger removal flutes form the main removal channels and the other removal flutes of smaller size act as auxiliary removal channels.

To attain smooth running of the rock drill during operation, preferably the transverse cross-sections of two first removal flutes located diametrically opposite one another are larger than the transverse cross-sections of two second removal flutes also located diametrically opposite one another.

The different sized transverse cross-sections of the removal flutes can be afforded by flutes which expediently have different large radial spacings from the axial center of the drilling head. Effective true rotational running properties of the rock drill are achieved where expediently the two first removal flutes located diametrically opposite one another have smaller radial spacings than the two second removal flutes also located diametrically opposite one another.

The radial spacing of the two first removal flutes is in the range of 0.05 to 0.25 times the outside diameter of the drilling head. The radial spacing of the two second removal flutes is preferably in the range of 0.10 to 0.35 times the outside diameter of the drilling head. Due to the relatively deep removal flutes, the dimension of the removal flutes in the circumferential direction of the drilling head can be small and the part of the circumference of the drilling head in contact with the bore hole surface can remain large.

Different transverse cross-sections of the removal flutes can be achieved advantageously with the two first removal flutes located diametrically opposite one another having a larger extent in the circumferential direction of the drilling head than the two second removal flutes also located diametrically opposite one another.

True rotational running properties are also attained in an expedient manner with the first removal flutes located diametrically opposite one another located at an angle of 60°–90° relative to the two second removal flutes located diametrically opposite one another. In the case of an alignment of both removal flutes located diametrically opposite one another at an angle of approximately 60°, it is possible to form two removal flutes located diametrically opposite one another to be particularly large, which provides a good removal of the drillings and assures a high drilling advance.

To obtain a rapid removal of the drillings from the region of the drilling head, the removal flutes are arranged to run in the axial direction of the drilling head. The drillings flow from the removal flutes in the drilling head into the conveying flutes in the drilling shank where advantageously the conveying flutes extend helically. The helically shaped conveying flutes assure the continued passage of the drillings from the deepest region of the bore hole to the bore hole surface.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
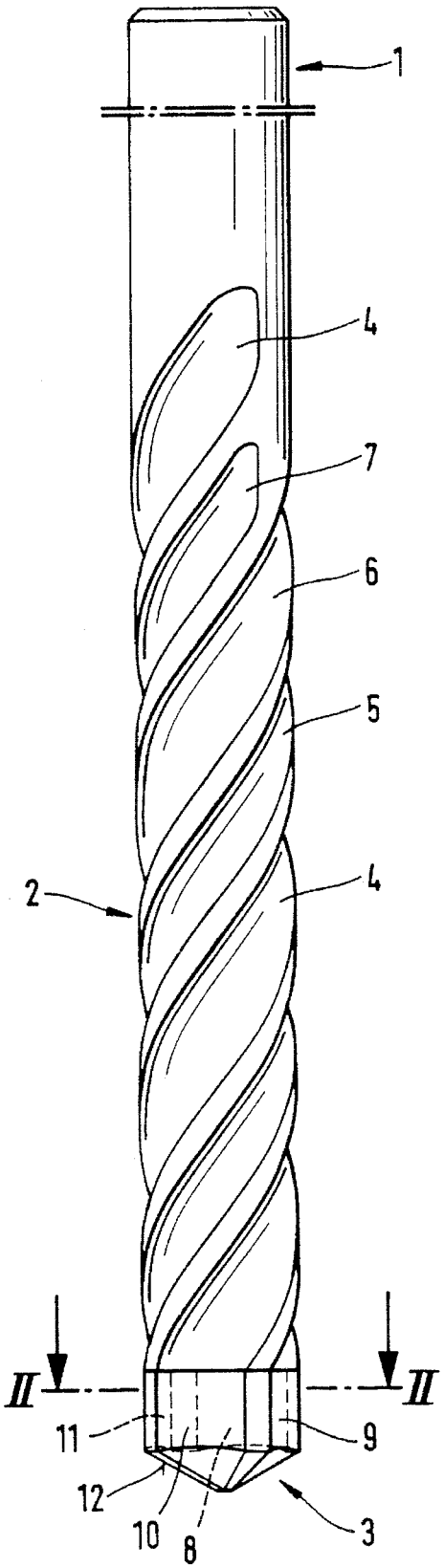
FIG. 1 is an axially extended view of a rock drill embodying the present invention and formed of a chucking shank part, a drilling shank part and a drilling head.
Figure 2:
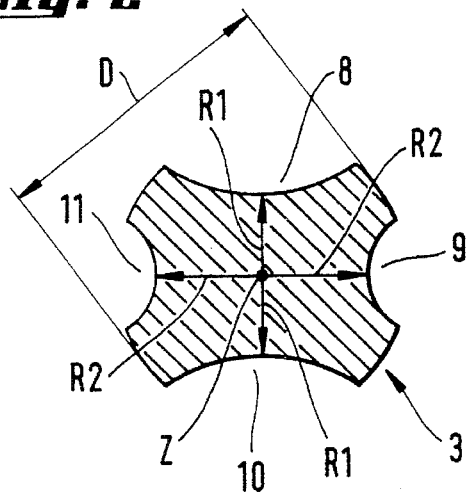
FIG. 2 is a transverse cross-sectional view of the drilling head of the rock drill in FIG. 1 taken along the line II—II and illustrated on an enlarged scale.

In FIGS. 1 and 2, a rock drill has an axially elongated shank with a chucking shank part 1 at one end, a drilling shank part 2 extending from the chucking shank part with four drillings conveying flutes 4, 5, 6, 7 arranged next to one another in a parallel manner and extending helically, and with a drilling head 3 formed entirely of hard metal secured to the opposite end of the drilling shank part 2 from the chucking shank part. The drilling head 3 has four removal flutes 8, 9, 10, 11 uniformly spaced around its outer circumferential surface. The radial spacings R1 from the center Z of the drilling head of the two first removal flutes 8, 10 located diametrically opposite one another are smaller than the radial spacings R2 of the two second removal flutes 9, 11 also located diametrically opposite one another.

In the free end region of the drilling head 3 of the rock drill displayed in FIG. 1, at least one cutting edge 12 is arranged extending on the end face across the entire diameter of the drilling head 3. The cutting edge 12 serves for the removal of drillings or drilled material, not illustrated.

Figure 3:
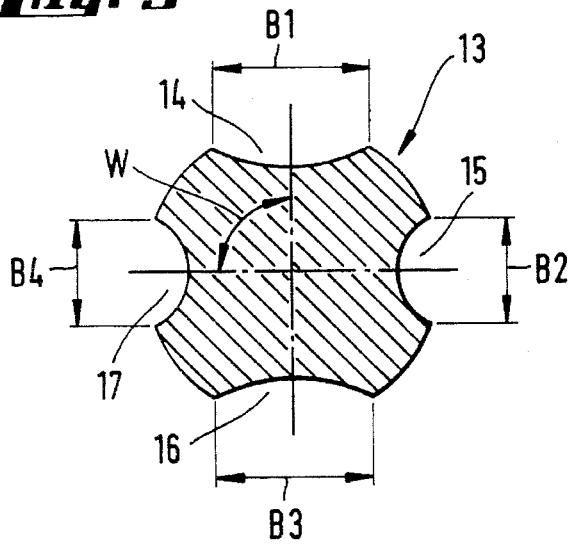
FIGS. 3 and 4 are transverse cross-sectional views of drilling heads of additional rock drills embodying the present invention and displayed on an enlarged scale as in FIG. 2.

In FIG. 3, a drilling head 13 is illustrated with four removal flutes 14, 15, 16, 17 spaced uniformly around the outer circumference of the head. The transverse cross-sections of the two first removal flutes 14, 16, located diametrically opposite one another, are larger than the transverse cross-sections of two second removal flutes 15, 17 also located diametrically opposite one another. The dimensions B1, B3 of the removal flutes 14, 16 in the circumferential direction of the drilling head 13 are larger than the corresponding circumferential dimensions B2, B4 of the removal flutes 15, 17. The removal flutes 14, 16 are spaced at an angle W of 90° relative to the removal flutes 15, 17.

Figure 4:
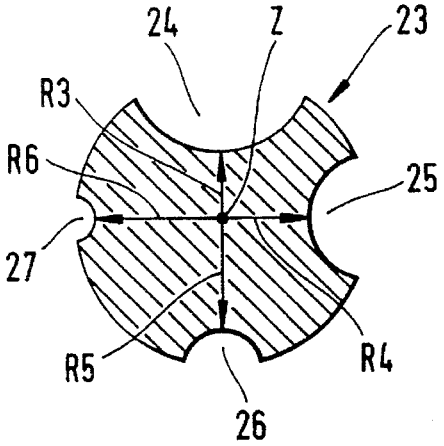

In FIG. 4 a drilling head 23 has four removal flutes 24, 25, 26, 27 spaced apart around the outer circumference and extending in the axial direction of the drilling head 23. Removal flutes 24, 25, 26, 27 each has a different transverse cross-sectional size. As a result, removal flutes 24, 25, 26, 27 each has a different radial space R3, R4, R5, R6 from the center Z of the drilling head 23.

Drilling head 3 illustrated in FIGS. 1 and 2 has an outside diameter D of essentially the same dimension as the outside diameter of the drilling shank part 2.

The drilling head 3 is secured to the drilling shank part 2 by a soldered connection. Centering means in the form of projections on the drilling head 3 serve for improved centering during the soldering operation and for the formation of a larger connecting surface. The projections extend into correspondingly shaped recesses in the end of the drilling shank part 2, not shown. Such projections or recesses are preferably disposed in the center region of the rock drill. Such projections can be cone shaped.

While specific embodiments of the invention have been shown and described in detail to illustrate the inventive principles, it will be understood that the invention may be embodied otherwise without departing from such principles.

We claim:

1. Rock drill comprising an axially elongated shank having a chucking shank part (1) at a first end, and a drilling shank part (2) extending from said chucking shank part with at least four conveying flutes (4, 5, 6, 7) formed in an outside surface of said drilling shank and extending parallel to one another, and a drilling head (3, 13, 23) at a second end secured to said drilling shank part and formed of a hard metal, said drilling head having four removal flutes (8, 9, 10, 11, 14, 15, 16, 17, 24, 25, 26, 27) extending in the axial direction of said shank and spaced apart about an outside circumferential surface thereof; said removal flutes (8, 9, 10, 11, 14, 15, 16, 17, 24, 25, 26, 27) and conveying flutes (4, 5, 6, 7) are in register at a transition from said drilling head (3, 13, 23) to said drilling shank part (2) wherein the improvement comprises that said removal flutes (8, 9, 10, 11, 14, 15, 16, 17, 24, 25, 26, 27) have transverse cross-sections of different sizes.

2. Rock drill, as set forth in claim 1, wherein the transverse cross-section of two first said removal flutes (8, 10, 14, 16) located diametrically opposite one another are larger than the transverse cross-sections of two second said removal flutes (9, 11, 15, 17) located diametrically opposite one another.

3. Rock drill, as set forth in claim 1 or 2, wherein said removal flutes (8, 9, 10, 11, 24, 25, 26, 27) have different radial spacings (R1, R2, R3, R4, R5, R6) from an axial center Z of said drilling head (3, 23).

4. Rock drill, as set forth in claim 3, wherein said two first removal flutes (8, 10) located diametrically opposite one another have a smaller radial spacing (R1) from said axial center (2) than said two second removal flutes (9, 11) located diametrically opposite one another.

5. Rock drill, as set forth in claim 4, wherein the drilling head (3) has an outside diameter (D) and the radial spacing (R1) between said two first removal flutes (8, 10) and the center (Z) is in the range of 0.05 to 0.25 times the outside diameter (D) of said drilling head (3).

6. Rock drill, as set forth in claim 3, wherein the drilling head (3) has an outside diameter (D) and the radial spacing (R2) between said two second removal flutes (9, 11) and the center (Z) is in the range of 0.1 to 0.35 times the outside diameter (D) of said drilling head (3).

7. Rock drill, as set forth in claim 2, wherein said two first removal flutes (8, 10, 14, 16) located diametrically opposite one another have a greater dimension (B1, B3) extending in the circumferential direction of the drilling head (3, 13) than said two second removal flutes (9, 11, 15, 17) located diametrically opposite one another.

8. Rock drill, as set forth in claim 2, wherein said two first removal flutes (14, 16) located diametrically opposite one another are disposed at an angle (W) in the range of 60° to 90° relative to said two second removal flutes (15, 17) located diametrically opposite one another.

9. Rock drill, as set forth in claim 1 or 2, wherein said conveying flutes (4, 5, 6, 7) extend helically.

* * * * *